US008453540B2

(12) United States Patent
Ellis

(10) Patent No.: US 8,453,540 B2
(45) Date of Patent: Jun. 4, 2013

(54) BULB CHANGING SYSTEM

(76) Inventor: James Childs Ellis, Atlanta, GA (US)

( * ) Notice: Subject to any disclaimer, the term of this patent is extended or adjusted under 35 U.S.C. 154(b) by 366 days.

(21) Appl. No.: 12/953,529

(22) Filed: Nov. 24, 2010

(65) Prior Publication Data

US 2012/0125161 A1 May 24, 2012

(51) Int. Cl.
*H01K 3/32* (2006.01)

(52) U.S. Cl.
USPC ..... 81/53.12

(58) Field of Classification Search
USPC ..... 81/53.11, 53.12, 57.3
See application file for complete search history.

(56) References Cited

U.S. PATENT DOCUMENTS

| | | | | |
|---|---|---|---|---|
| 87,531 | A * | 3/1869 | Wilcox | 81/57.3 |
| 609,421 | A * | 8/1898 | Edwards | 81/53.12 |
| 634,419 | A | 10/1899 | Welden | |
| 1,210,835 | A * | 1/1917 | Price | 81/53.12 |
| 1,847,953 | A | 3/1932 | Finesey | |
| 2,983,541 | A * | 5/1961 | Maki | 81/53.11 |
| 3,776,584 | A | 12/1973 | Van Gerven | |
| 4,304,156 | A | 12/1981 | Boudet | |
| 4,402,038 | A | 8/1983 | Hartung | |
| 5,692,417 | A | 12/1997 | Irpino | |
| 5,765,453 | A | 6/1998 | Mims | |
| 6,152,426 | A | 11/2000 | Von Fange | |
| 6,640,667 | B1 | 11/2003 | Pomerantz | |
| 6,883,400 | B2 | 4/2005 | Sugano | |
| 7,131,352 | B1 | 11/2006 | Saunders | |
| 7,143,668 | B2 | 12/2006 | Johnson | |
| 7,255,024 | B2 | 8/2007 | Johnson | |
| 7,334,503 | B1 | 2/2008 | Newman | |
| 2011/0061498 | A1 * | 3/2011 | Johnson et al. | 81/53.12 |

FOREIGN PATENT DOCUMENTS

| | | |
|---|---|---|
| CN | 2182462 | 11/1994 |
| CN | 2190737 | 3/1995 |
| CN | 2771648 | 4/2006 |
| KR | 20020087525 | 11/2002 |

* cited by examiner

*Primary Examiner* — Hadi Shakeri
(74) *Attorney, Agent, or Firm* — Anthony J DoVale

(57) ABSTRACT

A bulb changing system for elevated light bulbs is presented. The system has an elongate tube, a drive shaft with a drive handle, a drive gear, a driven gear, and a light receptacle configured to engage an exterior portion of the light bulb. In one aspect, the drive housing houses the drive gear and the driven gear therein a drive cavity and rotation of the drive handle causes the drive gear to rotate substantially along the longitudinal axis of the elongate tube, which in turn, causes the driven gear to rotate, which in turn, causes the light receptacle to rotate. As such, the light bulb is rotated into or out of engagement with a socket, depending upon the direction of rotation.

11 Claims, 7 Drawing Sheets

BULB CHANGING SYSTEM

FIELD OF THE INVENTION

Presented herein is a bulb changing system. More specifically, a bulb changing system primarily used to change light bulbs in difficult to reach areas.

BACKGROUND OF THE INVENTION

In the chandelier industry, lighting systems comprise a plurality of light bulbs. While the bulbs are designed to last for years, eventually they burn out and need to be replaced. Chandeliers are generally installed in locations where it is difficult to access the bulbs, even by using ladders. Where the bulbs are readily accessed via ladder, it can be difficult and dangerous to do so.

What is needed in the industry is a system for changing bulbs in chandeliers that is both safe and easy.

SUMMARY

Presented herein is a bulb changing system comprising an elongate tube, a drive shaft with a drive handle, a drive gear, a driven gear, and a light receptacle configured to engage an exterior portion of the light bulb.

The drive housing houses the drive gear and the driven gear therein a drive cavity. In one aspect, rotation of the drive handle causes the drive gear to rotate substantially along the longitudinal axis of the elongate tube, which in turn, causes the driven gear to rotate, which in turn, causes the light receptacle to rotate. As such, the light bulb is rotated into or out of engagement with a socket, depending upon the direction of rotation.

Other aspects and embodiments of the bulb changing system are described herein. This description is meant to fully describe the bulb changing system, but not limit its design, function, or application.

BRIEF DESCRIPTION OF THE DRAWINGS

These and other features of the preferred embodiments of the present invention will become more apparent in the detailed description in which reference is made to the appended drawings wherein.

DETAILED DESCRIPTION OF THE INVENTION

Figure 1:
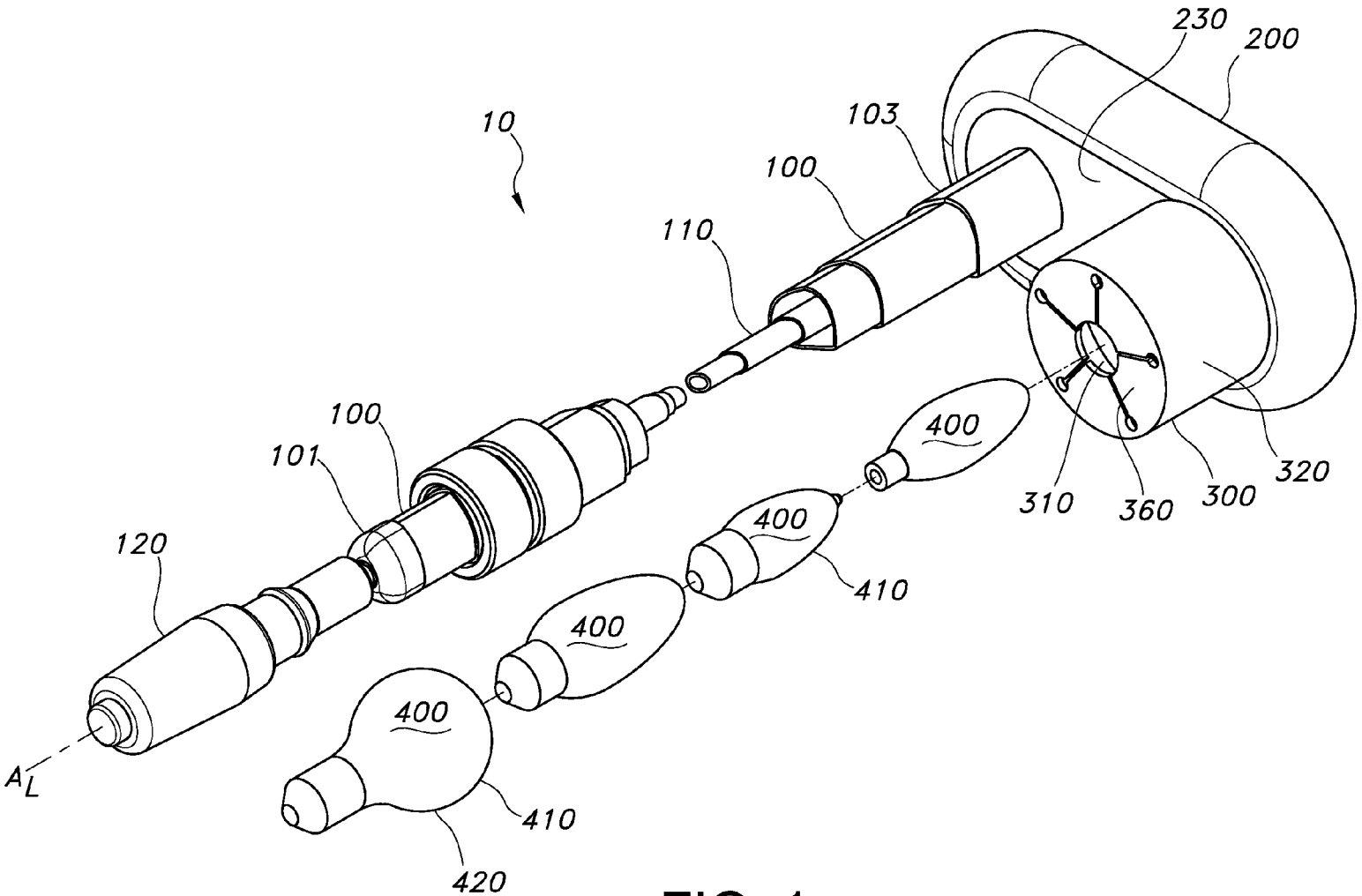
FIG. 1 is a perspective view of one aspect of a bulb changing system, showing a bulb receptacle capable of changing bulbs of various sizes.
Figure 2:
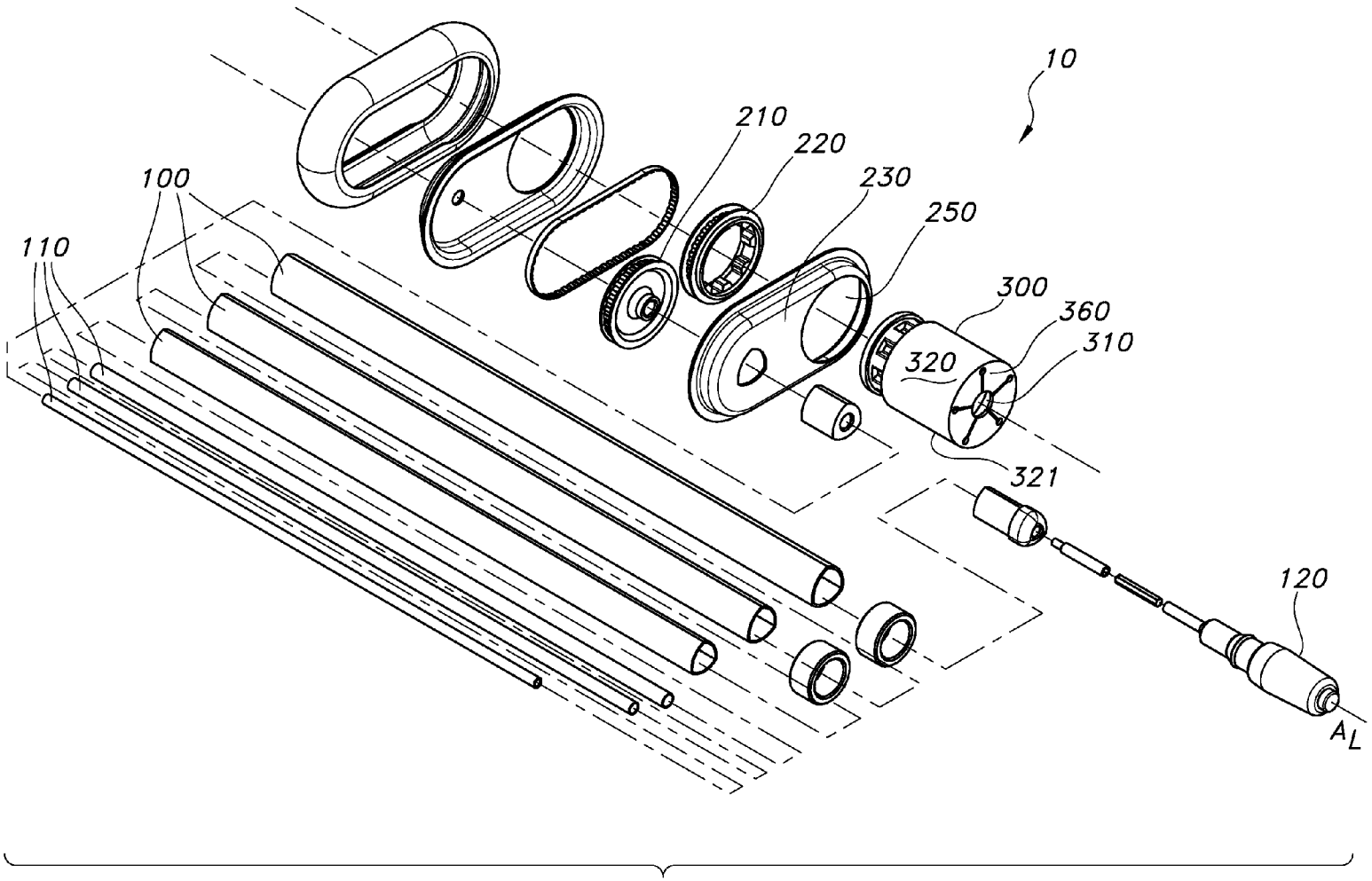
FIG. 2 is a an exploded perspective view of one aspect of the bulb changing system of FIG. 1, showing a multi-part elongate tube.

The present invention can be understood more readily by reference to the following detailed description, examples, drawing, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a bulb" can include two or more such bulbs unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Presented herein is an apparatus 10 for changing a light bulb 400. In one aspect, the apparatus 10 comprises an elongate tube 100, a drive shaft 110 with a drive handle 120, a drive gear 210, a driven gear 220, and a light receptacle 300.

The elongate tube 100 defines an interior longitudinal cavity 130 in which the elongate drive shaft 110 is positioned. The drive handle 120 can be positioned at least adjacent the proximal end 101 of the elongate tube. On the other, distal end 103 of the elongate tube, a drive housing 200 is positioned.

The drive housing 200 houses the drive gear 210 and the driven gear 220 therein the drive cavity 205. In one aspect, the drive handle 120 is operatively connected to the drive gear via the drive shaft and is the mechanism by which a user would turn the drive shaft 110. The first face 230 of the drive housing substantially faces the user (i.e. is closer to the drive handle). The second face 240 of the drive housing faces away from the user. In one aspect, at least one of the first or second faces of the drive housing defines a receptacle aperture 250. In another aspect, both faces define a receptacle aperture 250. As can be appreciated, in one aspect, one or both faces of the housing 200 can be substantially normal to the elongate tube.

Figure 5:
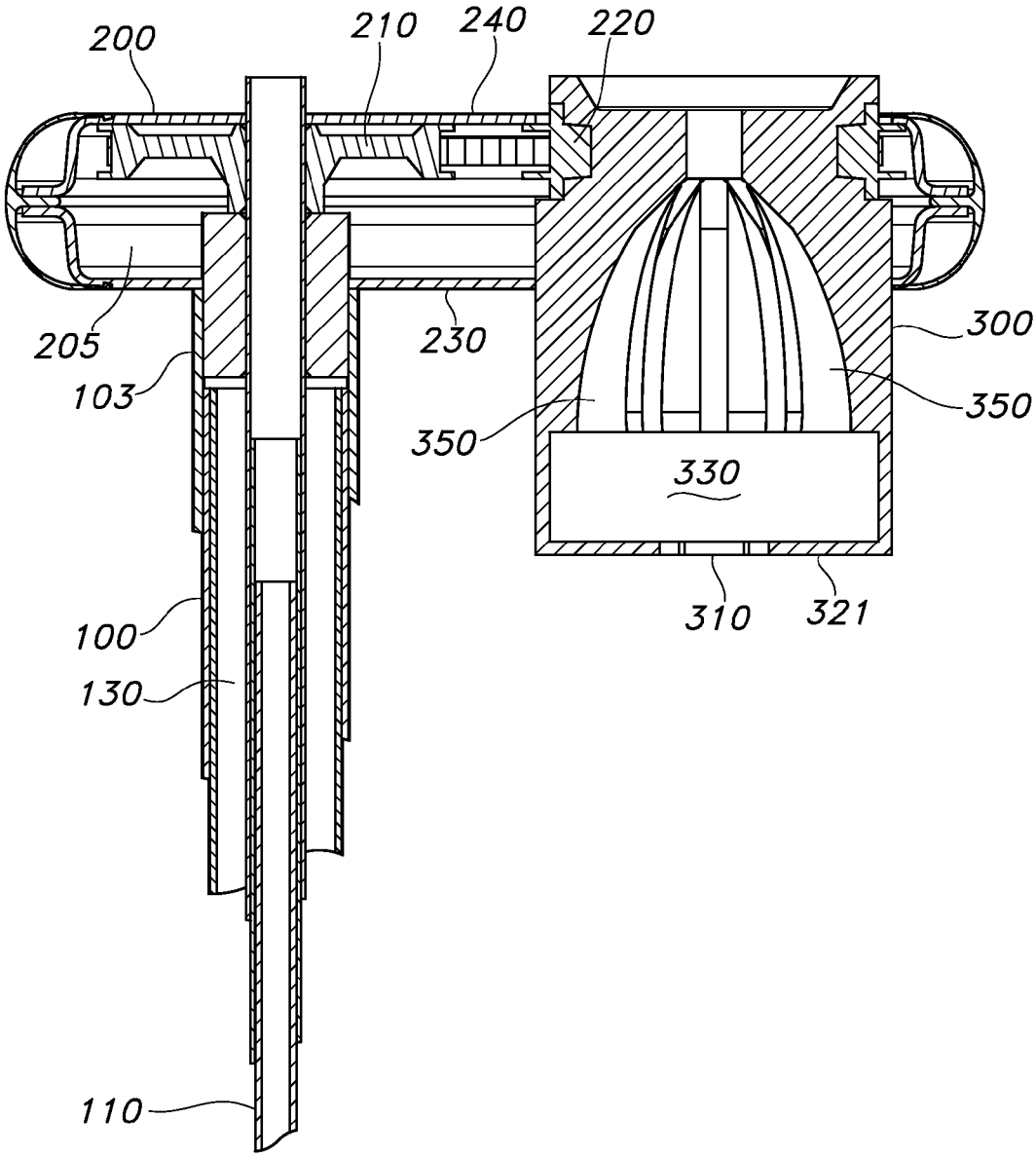
FIG. 5 is a right elevational cut-away view of the drive housing and bulb receptacle of the bulb changing system of FIG. 1.
Figure 6:
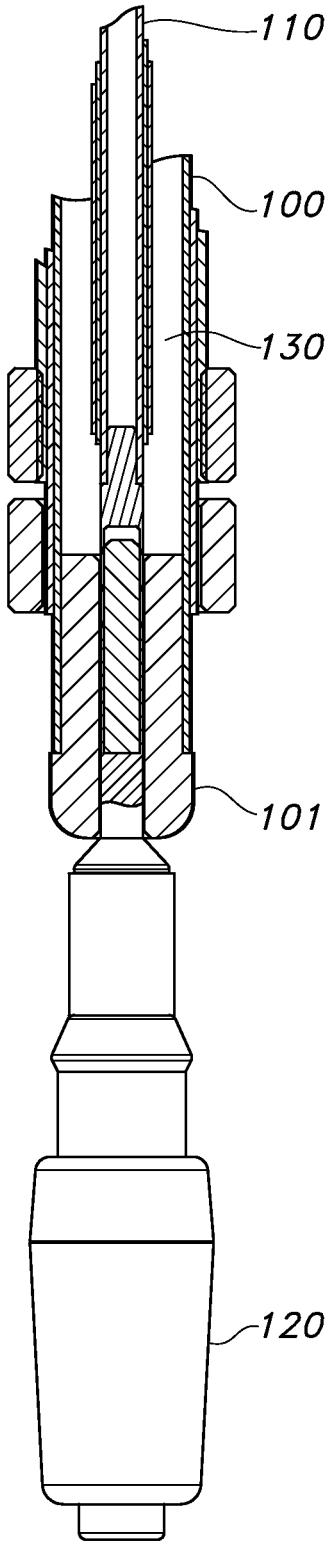
FIG. 6 is a right elevational cut-away view of a portion of the bulb changing system of FIG. 1, showing the interaction of the elongate tube and drive shaft.

As illustrated in FIG. 5, in one aspect, the light receptacle 300 is operatively coupled to the driven gear 220 and extends therefrom the receptacle aperture. The light receptacle is configured to engage an exterior portion 410 of the light bulb 400. In this configuration, rotation of the drive handle 120 causes the drive gear to rotate substantially along the longitudinal axis $A_L$ of the elongate tube 100, which in turn, causes the driven gear to rotate, which in turn, causes the light receptacle to rotate. As such, the light bulb is rotated into or out of engagement with a socket, depending upon the direction of rotation.

The drive gear and driven gear pictured are belt driven. However, other types of gears are contemplated and can be used in this apparatus. For example, and not meant to be limiting, spur gears, bevel gears, worm gears, and the like.

Since, of course, most chandeliers are elevated, one optional design is configured to make the elongate tube selectively extendable and to make the drive shaft telescoping to extend and retract along with the elongate tube. In one exemplified aspect, the elongate tube is extendable from about 20 inches to about 120 inches. In another aspect, the elongate tube 100 is extendable from about 36 inches to about 90 inches.

The drive handle can be merely a handle that is directly connected to the drive shaft 110, whereby rotation of the handle 120 has a direct rotational relationship to the drive handle. In one exemplified aspect, the drive handle can comprise a ratchet mechanism (not shown), as is well known in the art. Thus rotation of the drive handle in a first engaged direction rotates the drive shaft in the first direction, while rotation in a second disengaged direction does not rotate the drive shaft, but merely rotates the handle 120 to position the user to again rotate the handle in the first engaged direction. As can be appreciated, the ratchet mechanism can be configured to selectively change which direction is engaged and which direction is disengaged. In still another aspect, the drive handle can comprise a motorized mechanism to turn the drive shaft 110 or can be configured to accept a common household drill for the same purpose.

Figure 4:
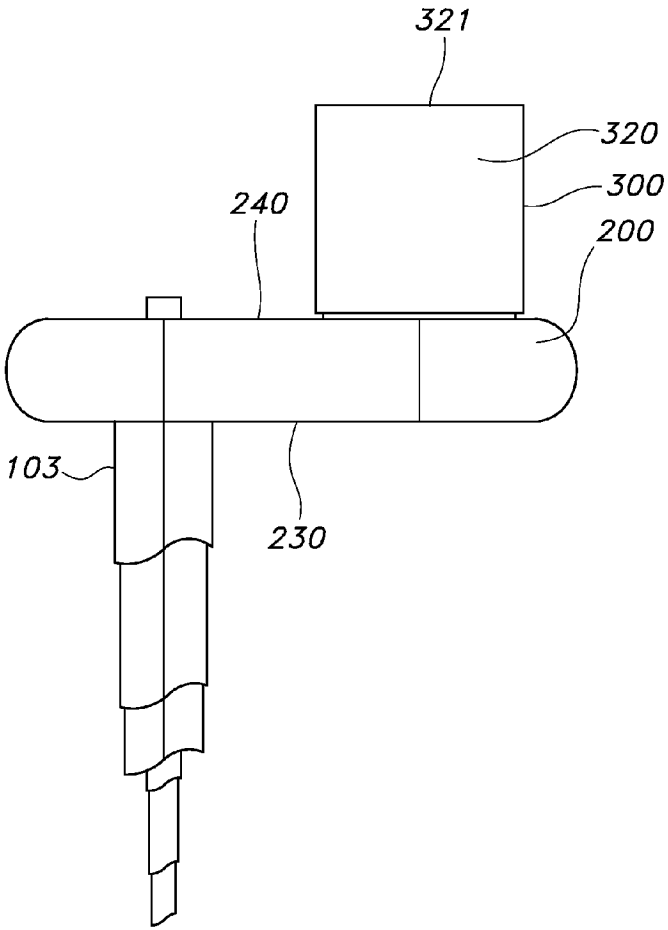
FIG. 4 is a right elevational view of the bulb changing system of FIG. 1, showing a light receptacle protruding therefrom the second face of the drive housing.
Figure 3:
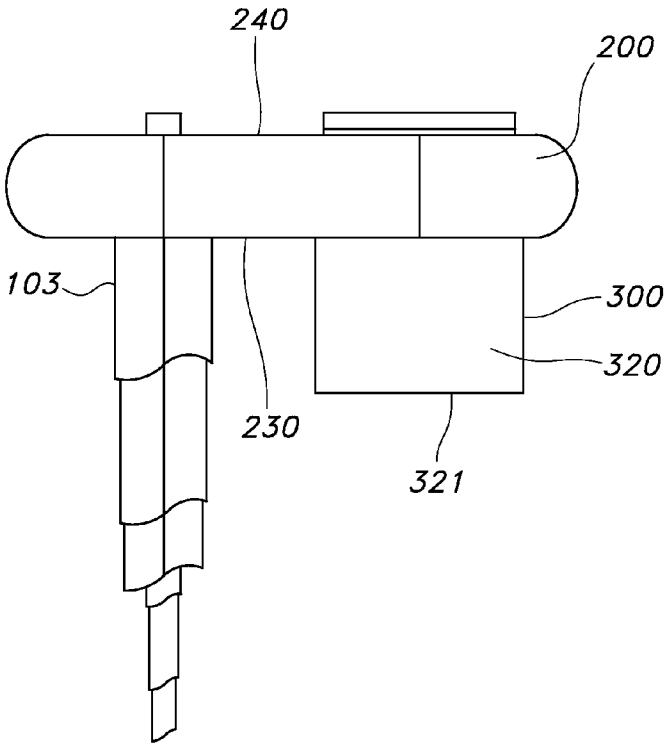
FIG. 3 is a right elevational view of the bulb changing system of FIG. 1, showing a light receptacle protruding therefrom the first face of the drive housing.

As illustrated in FIG. 1, in one exemplified aspect, the receptacle aperture extends through the first and second face of the drive housing. However, in another aspect, as shown in FIGS. 3 and 4, the light receptacle 300 can be selectively coupled to the driven gear 220 and moveable from a first position in which the light receptacle extends from the first face 230, to a second position in which the light receptacle extends from the second face 240. In this aspect, the apparatus 10 can be configured to remove light bulbs that substantially face up, as well as light bulbs that substantially face down.

The light bulb changing apparatus can be configured to change light bulbs of various sizes by having a receptacle 300 that is accommodating or by changing out the receptacle to one of a different size. In one exemplified aspect, the light receptacle can engage light bulbs with a diameter from about 0.5 inches to about 5 inches. In another aspect, the light receptacle can engage light bulbs with a diameter from about 1 inch to about 3 inches.

Figure 7:
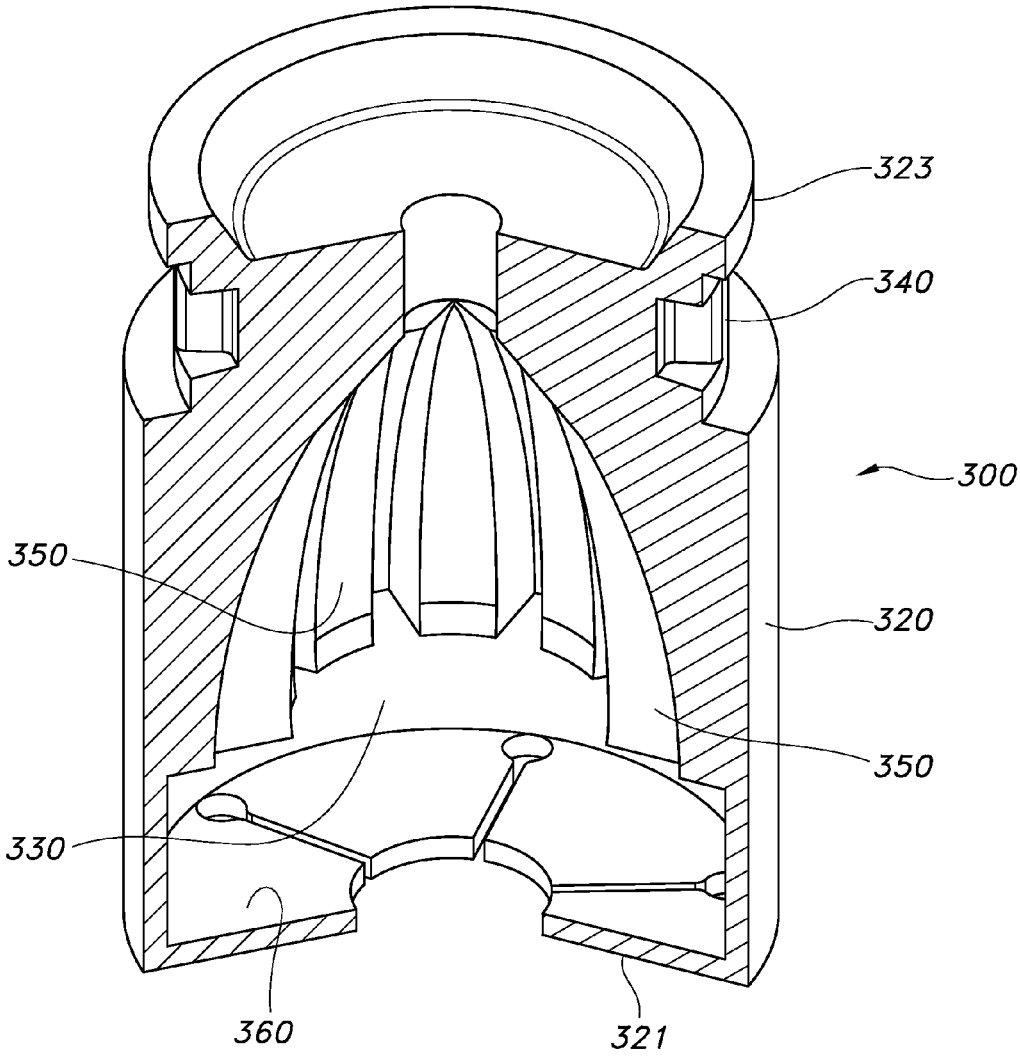
FIG. 7 is a partial cut-away perspective view of one aspect of the light receptacle of the bulb changing system of FIG. 1.
Figure 8:
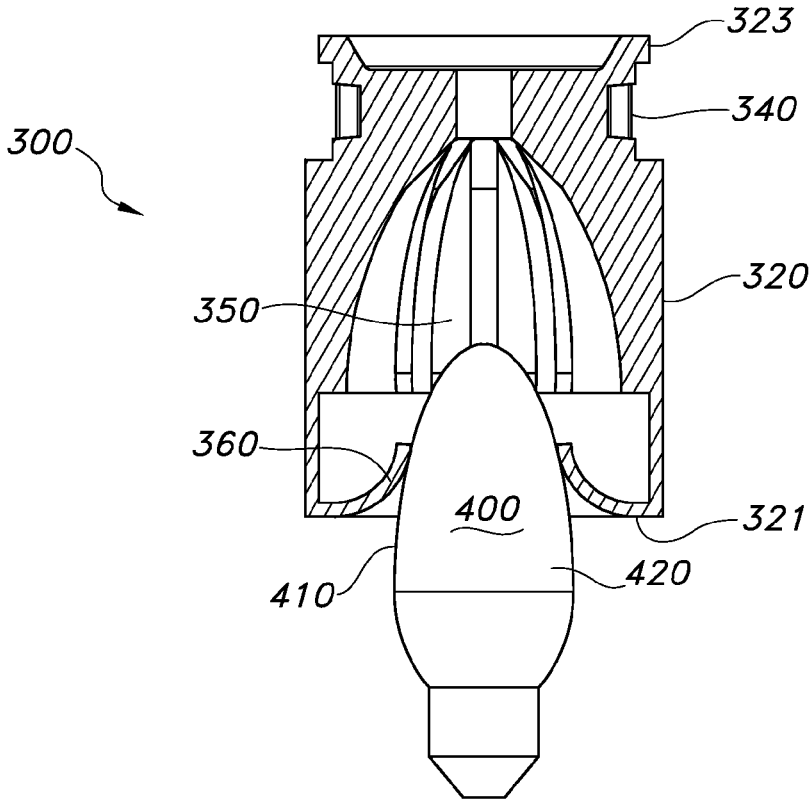
FIG. 8 is a partial cut-away perspective view of one aspect of the light receptacle of the bulb changing system of FIG. 1, showing the retention flaps in the second flexed position.
Figure 9:
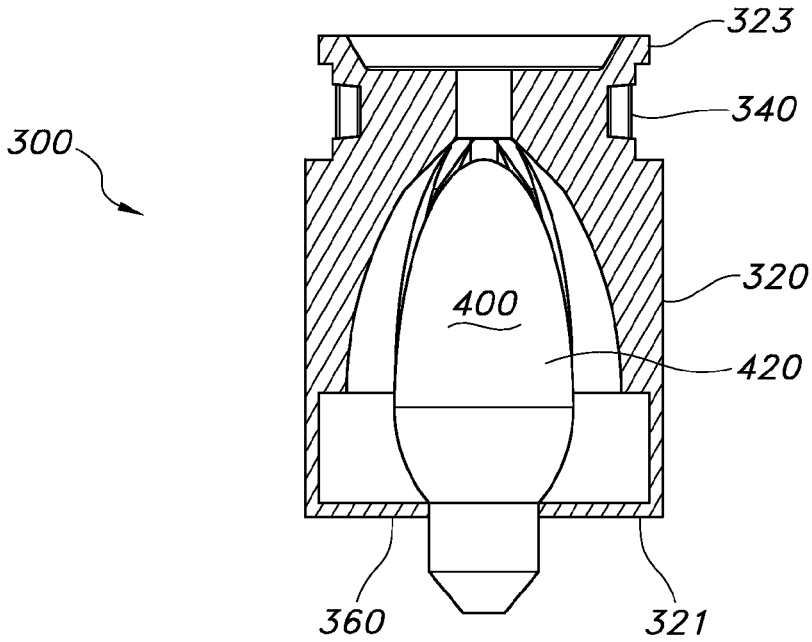
FIG. 9 is a partial cut-away perspective view of one aspect of the light receptacle of the bulb changing system of FIG. 1, showing the retention flaps in the first relaxed position.

In one aspect, as illustrated in FIG. 7, the light receptacle 300 comprises a receptacle body 320 defining a bulb cavity 330, an engaging surface 340 at a proximal end 323 of the receptacle body 320 for engaging a portion of the driven gear, a bulb aperture 310 at a distal end 321 of the receptacle body in communication with the bulb cavity 330, and a plurality of substantially flexible grabbers 350 positioned within the bulb cavity tailored to engage the light bulb. The grabbers 350 can comprise a resilient material such that they substantially conform to portions of the light bulb and frictionally engage the same. In one exemplified aspect, the resilient material comprises silicon rubber.

In one aspect, the receptacle 300 comprises a plurality of retention flaps 360 positioned substantially adjacent the distal end 321 of the receptacle body. The retention flaps 360, as shown in FIG. 7, are configured to be biased from a first relaxed position in which the retention flaps substantially resist movement of the bulb into or out of the bulb cavity, to a second flexed position in which the bulb is permitted to move into or out of the bulb cavity. As such, when receptacle is placed in contact with the external portion of the bulb and the body 420 of the bulb is pushed past the retention flaps, the retention flaps 360 return to the relaxed position near the neck of the bulb and resist removal of the bulb from the bulb cavity 330.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

I claimed:

1. An apparatus for changing a light bulb, comprising:

an elongate tube having a distal end, a proximal end, defining an interior longitudinal cavity and having a longitudinal axis;

an elongate drive shaft positioned therein the longitudinal cavity;

a drive handle positioned at the proximal end of the elongate tube, operatively connected to the drive shaft;

a drive housing positioned at the distal end of the elongate tube defining a drive cavity therein, the drive housing having a first face and a opposed second face, wherein the first face is closer to the drive handle than the second face, and wherein the drive housing defines a receptacle aperture extending therethrough the first face and the second face;

a drive gear positioned therein the drive housing and operatively connected to the drive shaft;

a driven gear operatively connected to the drive gear; and a light receptacle operatively selectively coupled to the driven gear and extending therefrom the receptacle aperture, the light receptacle configured to engage an exterior portion of the light bulb, wherein the light receptacle is moveable from a first position in which the light receptacle extends from the first face, to a second position in which the light receptacle extends from the second face;

wherein, rotation of the drive handle causes the drive gear to rotate substantially along the longitudinal axis of the elongate tube, which in turn, causes the driven gear to rotate, which in turn, causes the light receptacle to rotate, whereby the light bulb is rotated into or out of engagement with a socket, depending upon the direction of rotation.

2. The apparatus of claim 1, wherein the elongate tube is selectively extendable and wherein the drive shaft is telescoping and extends and retracts along with the elongate tube.

3. The apparatus of claim 2, wherein the elongate tube is extendable from about 20 inches to about 120 inches.

4. The apparatus of claim 3, wherein the elongate tube is extendable from about 36 inches to about 90 inches.

5. The apparatus of claim 1, wherein the drive handle comprises a ratchet mechanism.

6. The apparatus of claim 1, wherein the light receptacle comprises means for engaging light bulbs with a diameter from about 0.5 inches to about 5 inches.

7. The apparatus of claim 6, wherein the light receptacle comprises means for engaging light bulbs with a diameter from about 1 inch to about 3 inches.

8. The apparatus of claim 1, wherein the light receptacle comprises:

a receptacle body defining a bulb cavity;

an engaging surface at a proximal end of the receptacle body for engaging a portion of the driven gear;

a bulb aperture at a distal end of the receptacle body in communication with the bulb cavity; and a plurality of substantially flexible grabbers positioned within the bulb cavity tailored to engage the light bulb.

9. The apparatus of claim 8, further comprising a plurality of retention flaps positioned substantially adjacent the distal end of the receptacle body, wherein the retention flaps are configured to be biased from a first relaxed position in which the retention flaps substantially resist movement of the bulb into or out of the bulb cavity, to a second flexed position in which the bulb is permitted to move into or out of the bulb cavity.

10. The apparatus of claim 1, wherein the first face is substantially normal to the elongate tube.

11. The apparatus of claim 10, wherein the second face is substantially normal to the elongate tube.

* * * * *